US007723651B2

(12) United States Patent
Yang

(10) Patent No.: US 7,723,651 B2
(45) Date of Patent: May 25, 2010

(54) HEATING PAD

(76) Inventor: Shuh-Tsai Yang, 2F-7, No. 12, Lane 609, Sec. 1, Chung Shin Rd., San Chung City, Taipei Hsien (TW)

( * ) Notice: Subject to any disclaimer, the term of this patent is extended or adjusted under 35 U.S.C. 154(b) by 504 days.

(21) Appl. No.: 11/594,969

(22) Filed: Nov. 9, 2006

(65) Prior Publication Data

US 2008/0110876 A1 May 15, 2008

(51) Int. Cl.
*H05B 3/34* (2006.01)

(52) U.S. Cl. ..... 219/528; 219/529; 219/216; 219/217; 219/211; 219/212; 219/544; 219/545; 219/549

(58) Field of Classification Search ..... 219/528–9, 219/216–7, 211–2, 544–5, 549
See application file for complete search history.

(56) References Cited

U.S. PATENT DOCUMENTS 5,095,559 A * 3/1992 Liljegren et al. ..... 4/541.2
5,910,267 A * 6/1999 Stricker ..... 219/548

* cited by examiner

*Primary Examiner*—Shawntina Fuqua
(74) *Attorney, Agent, or Firm*—Apex Juris, pllc; Tracy M Heims

(57) ABSTRACT

A heating pad is disclosed. The heating pad has a heating line received in a bag, wherein a plurality of heat preservation elements are slipped over the heating line; when the heating pad is electrified, a controller controls the temperature of the heating line for heat applying on a human body; when a electric source is turned off, the heating line stops being heated up, the heat preservation elements keeps on scattering heat outwards to extend the time of heat applying. The heat preservation elements can be ceramic pipes able to emit far infrared ray, so that during heat applying, the ceramic pipes can emit far infrared ray to get an effect of health care.

4 Claims, 2 Drawing Sheets

HEATING PAD

BACKGROUND OF THE INVENTION

1. Field of the Invention

The present invention is related to a heat compress device for human body, and especially to a heating pad with a plurality of ceramic pipes slipped over a heating line to absorb heat generated by the heating line for continuously keeping warm to prolong the effect of heat applying for human body.

2. Description of the Prior Art

Referring to FIG. 3 showing a kind of structure of heating pad quite widely sold in the markets presently, wherein mainly an upper and a lower electric conducting board a1 compose an electric conducting board set, the two electric conducting boards a1 have a plurality of ceramic electric resistance elements a2 sandwiched therebetween, and a soft heat durable insulating gel portion a3 enveloping the two electric conducting boards a1 and the ceramic electric resistance elements a2 to form a heat compress sheet "a". When in electric conducting, the two electric conducting boards a1 can generate heat to raise temperature and get the effect of applying heat on a human body, while the resistance in the ceramic electric resistance elements a2 is increased when the temperature of the heat compress sheet "a" is raised gradually, thus the degree of electric conducting between the two electric conducting boards a1 can be controlled, so that the heat compress sheet "a" will not induce danger in use by continuous heating.

As shown in FIG. 4 showing another kind of conventional structure of heating pad, the structure comprises mainly a bottom cushion "b" and a surface layer "c" connected with each other by stacking. The bottom cushion "b" is composed of two aluminum foil sandwiching layers b1, b2 sandwiching therebetween a woven cloth layer b3, the surface layer "c" includes a woven cloth surface layer c1 and an aluminum foil surface layer c2, the aluminum foil surface layer c2 is connected with a lower woven cloth strip "d" spaced away from it, the woven cloth strip "d" and the aluminum foil surface layer c2 are formed therebetween a plurality of heat conducting spaces "e" for receiving an electric heating line "f" and ceramic heat conducting blocks "g". When the electric heating line "f" is electrified, heat is transmitted to the two aluminum foil sandwiching layers b1, b2 and the aluminum foil surface layer c2 to afford heat applying on a human body; by the function of heat preservation of the ceramic heat conducting blocks "g", heat can be stored and is not subjected to losing, thereby the time for heat applying can be prolonged.

The above mentioned two kinds of heating pads both use ceramic material; the ceramic electric resisters in the first kind of conventional structure of heating pad are used for temperature controlling to avoid danger, while the ceramic heat conducting blocks in the second kind of conventional structure of heating pad are used for getting the effect of heat preservation. However, the electric heating line and the ceramic heat conducting blocks in the second kind of conventional structure of heating pad are received in the heat conducting spaces, heat generated by the electric heating line must be transmitted to the ceramic heat conducting blocks through the aluminum foil surface layer; and the heat conducting spaces are formed by connecting of the woven cloth strip with the aluminum foil surface layer, this looks complicated in the entire structure and increases the costs of material and work of processing.

In view of the above stated, the motivation of the present invention is to simplify the structure of heating pads to lower its cost, and improve the effect of heat applying and heat preservation.

SUMMARY OF THE INVENTION

The primary object of the present invention is to provide a heating pad, wherein a plurality of ceramic pipes slipped over a heating line, by the function of heat conducting and heat preservation of the ceramic pipes, the heating pad can maintain its heat applying effect for a period of time after it is turned off electrically, thereby electric power can be saved.

A secondary object of the present invention is to provide a heating pad, wherein a plurality of ceramic pipes slipped over a heating line can emit far infrared ray when in heat applying to obtain an effect of health care; by absorbing the irradiated heat from the heating line, the irradiated heat can be recovered for reuse; and further, the ceramic pipes can be in the state of being able to emit far infrared ray at any time.

In order to achieve the above stated objects of the present invention, the heating pad according to the present invention comprises a bag, a heating line, a controller and a plurality of heat preservation elements. The heating line is received in the bag, one end of the heating line is connected to an electric power source, and the other end is grounded; the controller is connected to the heating line to control the temperature to be increased by heating of the heating line; and the heat preservation elements are slipped over the heating line. Thereby when the electric heating line is electrified and heated up, the heating pad absorbs a part of heat generated by the heating line, so that it can continuously emits heat to extend the duration of heat applying.

In practicing, the heat preservation elements can be ceramic pipes, and the heat preservation elements can be hollow pipes able to irradiate far infrared ray.

The present invention will be apparent after reading the detailed description of the preferred embodiments in reference to the accompanying drawings.

DETAILED DESCRIPTION OF THE PREFERRED EMBODIMENT

Figure 1:
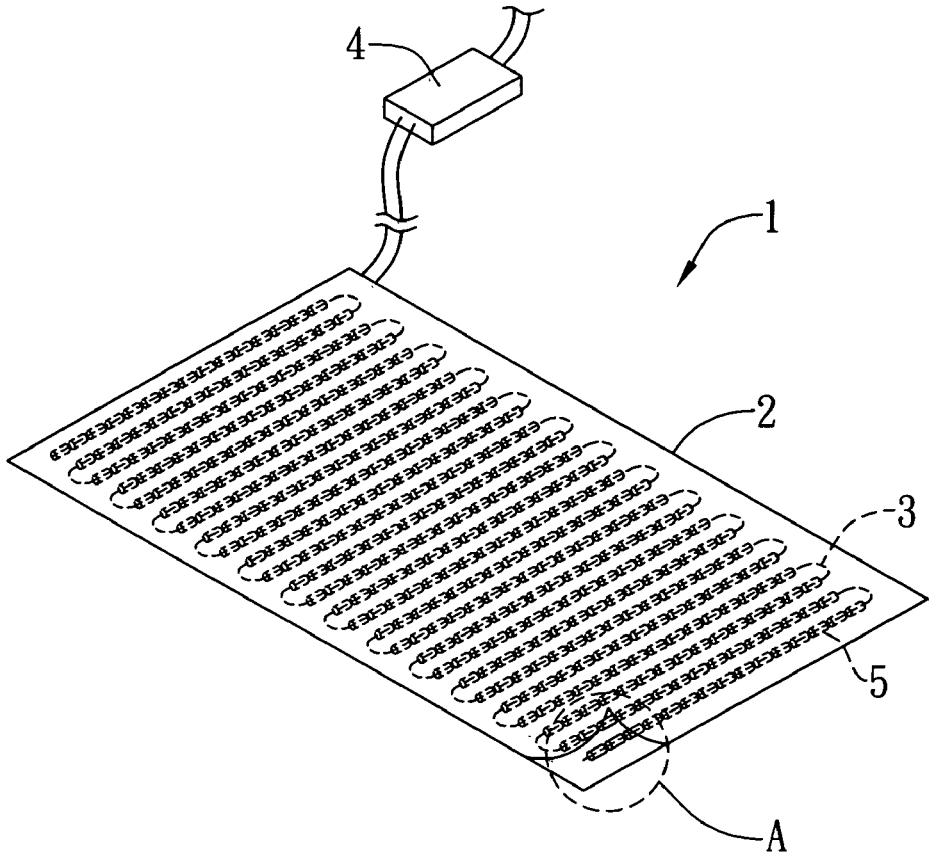
FIG. 1 is a perspective view of an embodiment of the present invention.
Figure 2:
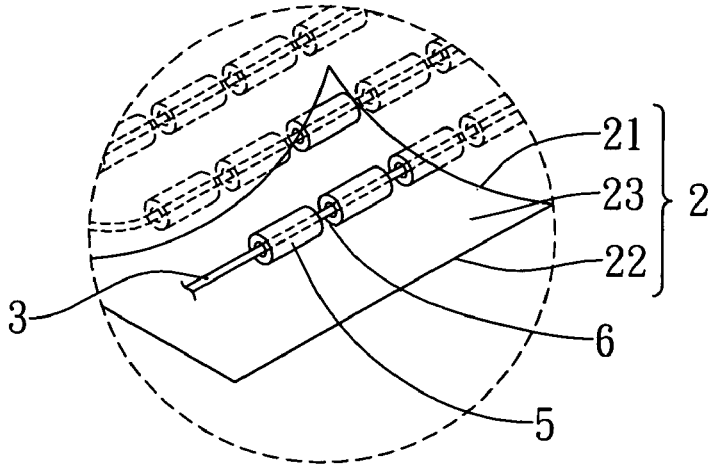
FIG. 2 is a partially enlarged perspective view of an A portion in FIG. 1.
Figure 3:
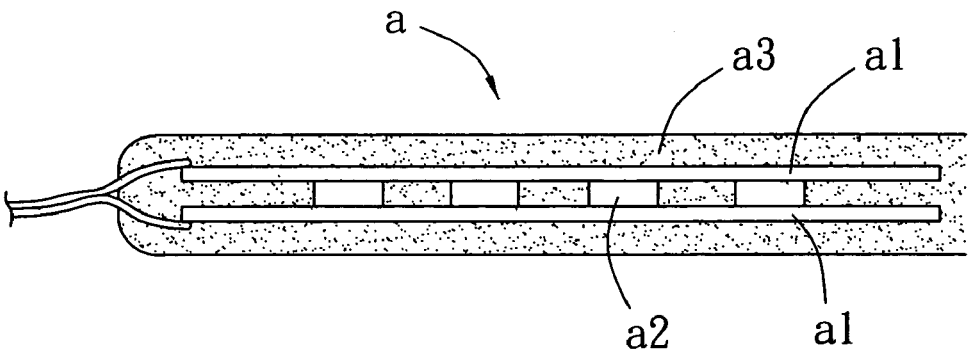
Fig. 3 (Prior Art)
FIG. 3 is a sectional view showing the structure of a conventional heating pad.
Figure 4:
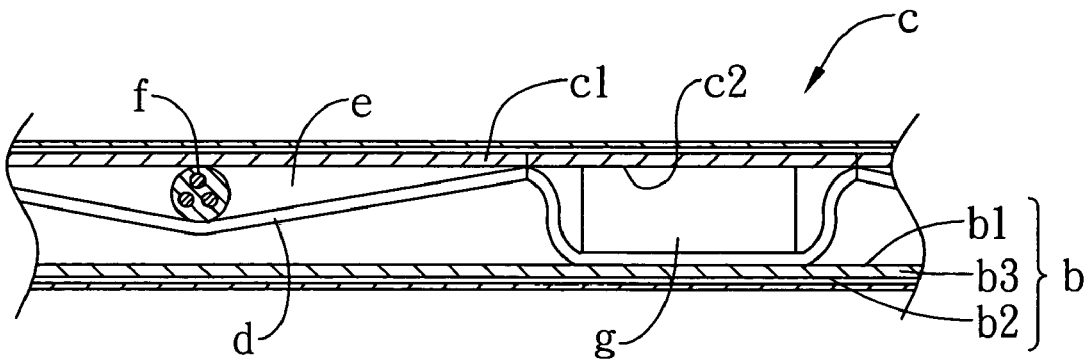
Fig. 4 (Prior Art)
FIG. 4 is a sectional view showing the structure of another conventional heating pad.

Referring to FIGS. 1 and 2, showing a preferred embodiment of a heating pad 1 of the present invention, the heating pad 1 comprises a bag 2, a heating line 3, a controller 4 and a plurality of heat preservation elements 5.

The bag 2 is formed by lap connecting of a surface layer 21 and a bottom layer 22; the bag 2 has therein a receiving space 23. The heating line 3 is received in the bag 2, and is connected to be received in the receiving space 23 between the surface layer 21 and the bottom layer 22 in a plane but arranged in a continuously and tortuously bending mode. One end of the heating line 3 is connected to an electric power source, and the other end is grounded; the controller 4 is connected between the heating line 3 and the electric power source. In practicing, the controller 4 is provided therein with a triggering circuit, a heat feed back circuit and a microprocessor all mutually connecting, the triggering circuit is connected to the heating line 3 to make the latter be heated under the control of the microprocessor and to adjust the time for heating; the structures of the heating line 3 and the controller 4 are of conventional techniques, thus are not further described about their content.

The heat preservation elements 5 are made of ceramic material, but can be made of some other material having the feature of heat conducting and heat preservation, in this embodiment, the heat preservation elements 5 are hollow ceramic pipes which are directly slipped over the heating line 3.

When the heat preservation elements 5 are slipped over the heating line 3; every two of the heat preservation elements 5 are kept a suitable gap 6 between themselves end to end to allow them to be able to bend for an angle to each other; thereby the bag 2 can make suitable deformation in pursuance of the shape of an area on a human body to be treated by heat applying. In practicing, the heat preservation elements 5 are slipped over and fixed on an outer periphery of the heating line 3, thereby the heat preservation elements 5 and the heating line 3 can be integrally formed to make the heat preservation elements 5 fixed on the heating line 3 at intervals, thus effects of heat conducting, heat preservation and bending can be obtained.

In completion of assembling the above members, when the heating line 3 is electrified and heated up, the heat generated by the heating line 3 is transmitted outwards and used for applying on a human body, also the heat emits outwards radially and is absorbed by the heat preservation elements 5. When the electric source is turned off, the heating line 3 stops being heated up, the heat preservation elements 5 keeps on conducting the stored heat outwards and extend the time of heat applying.

In practicing, the heat preservation elements 5 can also be added with material able to emit far infrared ray in order that the material can emit far infrared ray during heat applying. With the above stated structure having the heat preservation elements 5 slipped over the heating line 3, the heat preservation elements 5 can absorb irradiated heat from the heating line 3 when the latter is heated up, so that the structure can be in the state of being able to emit far infrared ray at any time.

Therefore, the present invention has the following advantages:

1. By the feature of heat conducting and heat preservation of the ceramic pipes, the present invention can maintain its heat applying effect for a period of time after it is turned off electrically; thereby electric power can be saved.
2. In heat applying, the present invention can emit far infrared ray to obtain an effect of health care.
3. Every two of the ceramic pipes are kept a suitable gap between themselves end to end to allow the present invention to be able to bend for heat applying at an area on a human body, the present invention thus is practicable.
4. The ceramic pipes provided in the present invention can recover the radiated heat generated by the heating line, so that in long time using, it can assure the effect of heating up and health care.
5. By the connecting of the ceramic pipes with the heating line of the present invention in the mode of slipping over, heat generated by the heating line scatters outwards radially from inside of the ceramic pipes, this makes effective heat conducting.
6. The ceramic pipes provided in the present invention can be directly slipped over the heating line to get the effects of heat conducting and heat preservation; this can reduce the costs of material and work of processing.

In conclusion, according to the above statement, the present invention surely can get the expected objectives to provide a structure of a heating pad that not only can be simplified, but also get the effects of heat applying and heat preservation as well as emitting far infrared ray for human body. Having now particularly described my invention that is industrially valuable, what we claim is declared in the claims followed.

The invention claimed is:

1. A heating pad comprising:

a bag;

a heating line received in said bag, one end of said heating line is connected to an electric power source, and the other end of said heating line is grounded;

a controller connected to said heating line to control temperature to be increased by heating of said heating line; and a plurality of heat preservation elements slipped over said heating line to absorb the heat generated by said heating line, so that said heat preservation elements continuously emits heat when said heating line stops being heated, said heat preservation elements being strung on said heating line and a gap is correspondingly formed between each two heat preservation elements, wherein said heat preservation elements are hollow pipes adapted to irradiating far infrared ray.

2. The heating pad as in claim 1, wherein said heat preservation elements are fixed on an outer periphery of said heating line.

3. The heating pad as in claim 2, wherein said heat preservation elements and said heating line are integrally formed to make said heat preservation elements fixed on said heating line at intervals.

4. A heating pad comprising:

a bag;

a heating line received in said bag, one end of said heating line is connected to an electric power source, and the other end of said heating line is grounded;

a controller connected to said heating line to control temperature to be increased by heating of said heating line; and a plurality of heat preservation elements slipped over said heating line to absorb the heat generated by said heating line, so that said heat preservation elements continuously emits heat when said heating line stops being heated, said heat preservation elements being strung on said heating line and a gap is correspondingly formed between each two heat preservation elements, wherein said heat preservation elements are hollow ceramic pipes adapted to irradiating far infrared ray.

* * * * *